US007458110B2

(12) United States Patent
Rie

(10) Patent No.: US 7,458,110 B2
(45) Date of Patent: Dec. 2, 2008

(54) HYGIENIC COMMODE FOR LADIES WITH REVERSE SITTING

(76) Inventor: Jin Rie, 110 N. Berendo St. #4, Los Angeles (KR)

( * ) Notice: Subject to any disclaimer, the term of this patent is extended or adjusted under 35 U.S.C. 154(b) by 497 days.

(21) Appl. No.: 11/121,728

(22) Filed: May 5, 2005

(65) Prior Publication Data

US 2006/0248635 A1 Nov. 9, 2006

(51) Int. Cl.
*E03D 11/00* (2006.01)

(52) U.S. Cl. ..... 4/254; 4/420; 4/353

(58) Field of Classification Search ..... 4/237, 4/254, 301, 405, 411, 661, 144.3, 300, 353, 4/420

See application file for complete search history.

(56) References Cited

U.S. PATENT DOCUMENTS

| | | | | |
|---|---|---|---|---|
| 2,185,887 | A * | 1/1940 | Dennis | 4/311 |
| 2,741,287 | A * | 4/1956 | Michaud | 4/661 |
| 3,964,111 | A | 6/1976 | Packer | 4/144.4 |
| 4,012,797 | A * | 3/1977 | Kristoffersen | 4/300 |
| 4,023,216 | A | 5/1977 | Li | 4/144.3 |
| 4,681,573 | A | 7/1987 | McGovern et al. | 604/329 |
| 4,777,671 | A | 10/1988 | Kearns | 4/667 |
| 4,815,151 | A | 3/1989 | Ball | 4/144.3 |
| 4,937,890 | A | 7/1990 | Taufur | 4/144.4 |
| 5,329,645 | A | 7/1994 | Fossum et al. | 4/254 |
| 5,996,133 | A | 12/1999 | Fletcher | 4/239 |
| 6,324,705 | B1 | 12/2001 | Zephier | 4/254 |
| 6,370,705 | B1 * | 4/2002 | Levinson | 4/301 |
| 6,571,399 | B1 * | 6/2003 | Wagener | 4/301 |
| 6,814,719 | B2 | 11/2004 | Preston et al. | 604/329 |

* cited by examiner

*Primary Examiner*—Tuan N Nguyen

(57) ABSTRACT

A commode chair with reversed seat facing a water tank and with a system for opening the labia of female user for hygienic urination and excretion is provided. The seat assembly including bowl, seat, and lid are formed to support a user to sit on a commode facing the water tank. The seating assembly has a narrow width to the direction of a water tank and has wider width on the opposite side. An overview of the seating assembly has a shape of an oval facing the water tank with the sharp end, a bicycle saddle shape, facing the water tank. The side view of the seating assembly shows elevated part that is close to the water tank. The water tank is leaned backwards in relation to the commode to allow a user to rest her upper body thereon. This sitting position reduces pressure build up of the lower body of the user around the commode seat and let the labia of the user open for the water from a vidette, located at the wider part of the bowl, to reach the inner side of the labia and clean therein from behind of the user. For defecation, the water tank is adjusted to a more upward position.

4 Claims, 8 Drawing Sheets

HYGIENIC COMMODE FOR LADIES WITH REVERSE SITTING

BACKGROUND OF THE INVENTION

When a woman sits on a conventional commode, where the water tank is always placed behind the user, all of the woman's weight is supported by a narrow area that is the seating assembly of the commode. Therefore, the pressure build up in the woman's lower body is more than negligible. For an overweight woman who suffers from constipation and hemorrhoids, these normal commodes provide great pain. Some commodes are modified to support patients who have difficulty in moving. However, those modified commodes do not eliminate the inconvenience for the users who suffer from such aforementioned ailments. In addition to these, due to the structure of a human female's gender organ, woman always need additional time to clean the leaks of urine and inner surface of labia even after urination. It is the purpose of the current application to provide a commode that gives a convenient and compatible resting time in addition to a hygienic excretion, including defecation, environment to all ladies.

1. Field of the Invention

Current application relates to a combination of a commode chair, a water tank, more particularly, to a new commode chair with enhanced user support for reducing pressure concentration points on the lower body of a user while providing a hygienic environment for excretion of ladies.

2. Description of the Prior Art

U.S. Pat. No. 6,324,705 to Zephier, U.S. Pat. No. 5,996,133 to Fletcher, U.S. Pat. No. 5,329,645 to Fossum, et. al., U.S. Pat. No. 4,777,671 to Kearns illustrates a commode chair with enhanced functions for handicapped user.

U.S. Pat. No. 6,814,719 to Preston, et al. illustrates a female urinary system comprising an appliance including a hollow open top urine receiving body having a peripheral rim for fitting under the urethra.

U.S. Pat. No. 4,937,890 to Tafur illustrates a flat-folded expandable urinary aid for use by females which allows them to urinate from a standing position. The tubular portion and funnel-shaped portions are formed by a pair of opposed planar side walls hinged together from the inlet end to the outlet end along their top and bottom longitudinal edges.

U.S. Pat. No. 4,815,151 to Ball illustrates an apparatus for guiding the flow of urine from a female is disclosed. It includes a urinary-guide unit which is shaped to the contours of the female genital region and constructed of one-piece, flexible material, secured in place manually or by means of specially constructed garments which can be used to store the unit when the unit is intended to be worn. The method of using this apparatus is also disclosed.

U.S. Pat. No. 4,681,573 to McGovern, et al. illustrates an oblique conical like urinary device for a standing female to direct a stream of urine a comfortable distance away from the body made of a temporarily fluid resistant material.

U.S. Pat. No. 4,023,216 to Li illustrates a rigid device of plastic or other suitable material which will gather the poorly defined urinary efflux of a urinating human female in a normal standing position and direct it forwardly and downwardly in a defined stream to impinge on a chosen spot. The device comprises a trough open at the top and adapted to be positioned to register with outlet of the urethra. From the forward end of the trough, there is a forwardly and downwardly inclined discharge conduit and there is also an absorbent pad at the rear of the trough to remove residual urine from the internal and external vulvae which comprises material that has a blotting action. This material is replaceable. Another embodiment is of foldable material such as suitable paper with a waterproof lining.

U.S. Pat. No. 3,964,111 to Packer illustrates a urine conducting apparatus is described which enables a woman to urinate from a standing position and which may be supported during use solely by the legs and body of the user. The urine conducting apparatus comprises an outer tapered flexible urine conductor having a wide inlet mouth contoured to envelop the perineum, and a liner adapted to fit within and cover the interior surface of the outer conductor. The inlet mouth of the conductor has a thickened rim containing embedded spring means constructed to enable the conductor to be supported within the crotch of the user in fluid tight engagement with the perineum by an inward movement of the user's legs.

None of the prior art illustrates a commode that can reduce the pressure build up in the lower body of the user drastically by resting the whole upper body of the user on the water tank.

SUMMARY OF THE INVENTION

The general purpose of the current application is to provide a new commode chair with enhanced user support generated by a leaned water tank. Specially designed reversed seat and the backwardly leaned water tank enables a woman user maintain a position with full open of her labia for extended period. To attain this, the present invention generally comprises a commode chair for enhancing sitting comfort on a commode, including a seat assembly and a water tank. The seat assembly supports the buttocks of a user. A commode chair with reversed seat facing a water tank and partially protruded seat is provided. The water tank supports the user for reducing pressure build up on the body. The seat assembly including bowl, and specially designed seat are formed to support a user, especially a woman user, to sit on a commode facing the water tank and hold it with her legs to open her labia fully for non-disturbed ejaculation of the urine drops. The seating assembly has a narrower width on the side, which is raised to surround and support the gender organ of a woman to open, closest to the water tank and has a wider width on the opposite side. An over view of the seating assembly has a shape of an oval facing the water tank with the narrow end. The water tank has a smooth, inwardly developed groove, along the horizontal direction thereof, for a woman hold it with both hands and rest her breast. The water tank is leaned backwards on the commode to allow a user to lean her upper body against thereon. This sitting position can be adjusted for relatively up-right position in case of defecation.

DETAILED DESCRIPTION OF THE PREFERRED EMBODIMENT

Figure 1:
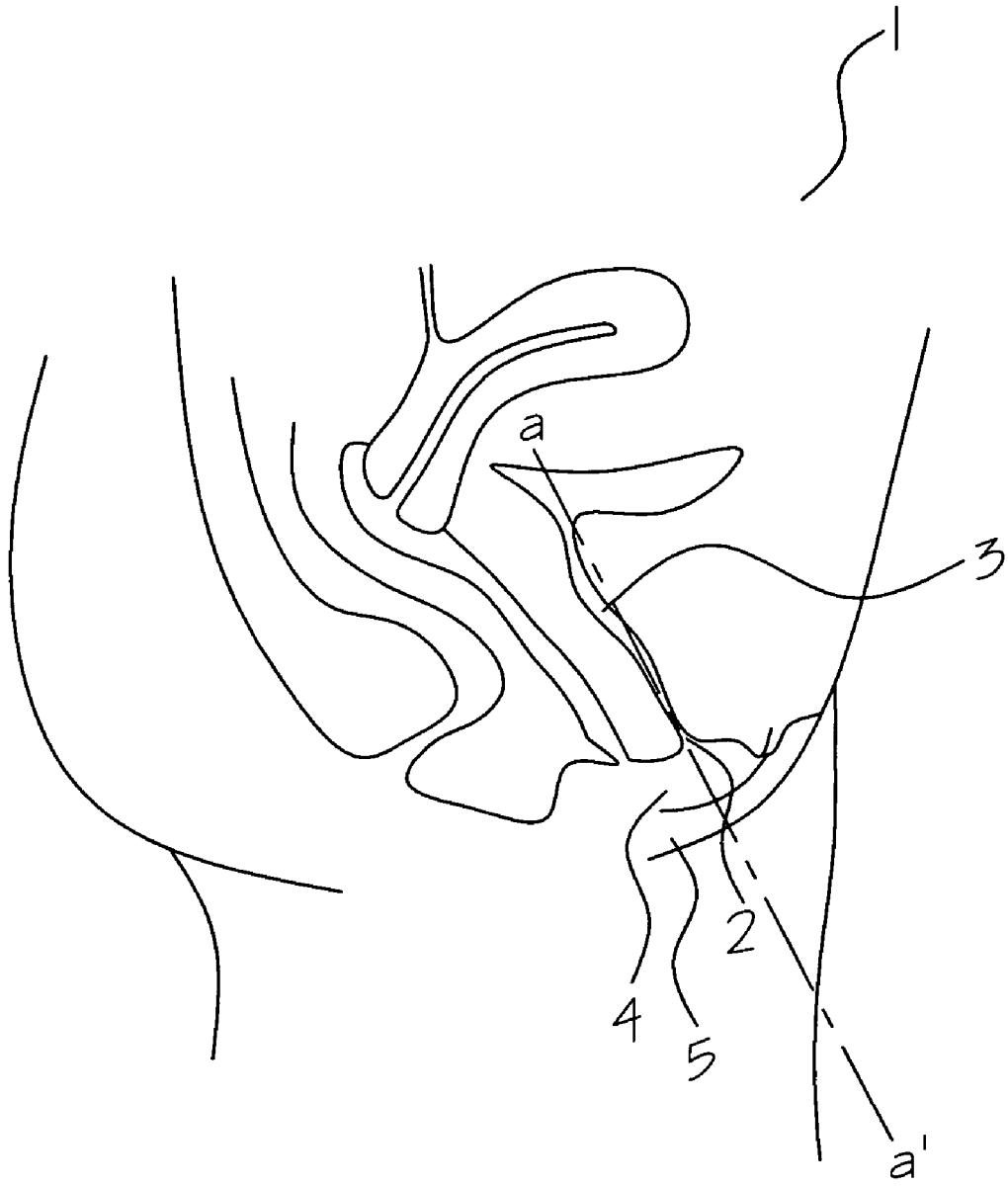
FIG. 1 is a cross-sectional side view of the gender organ of a human female.
Figure 2:
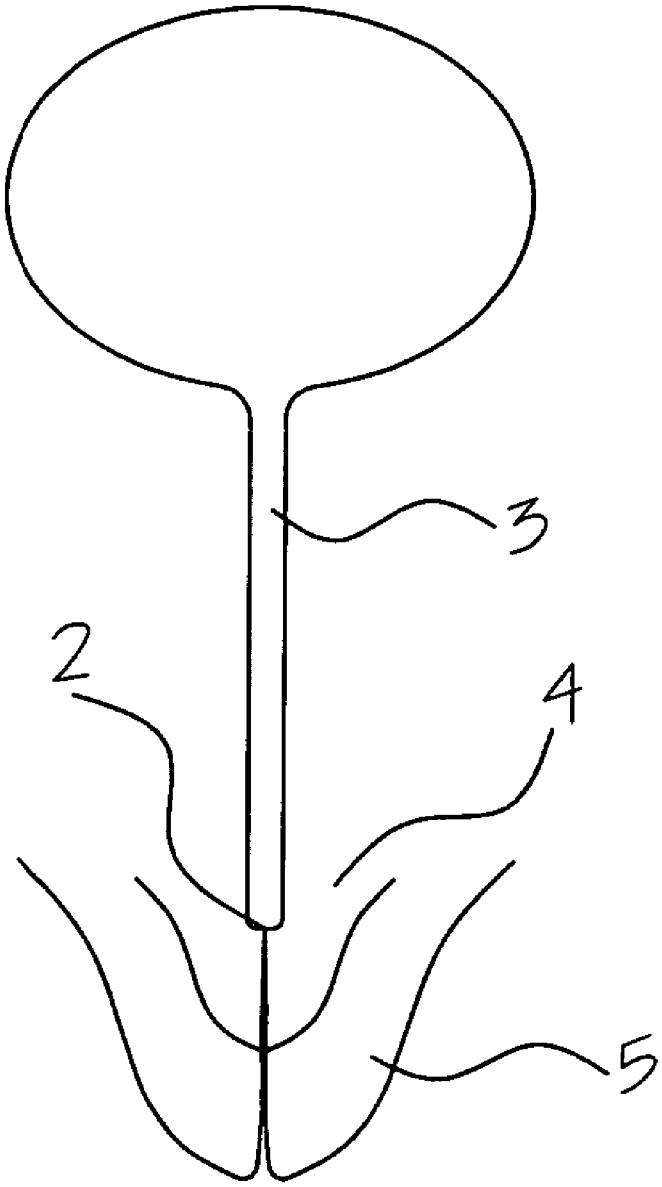
FIG. 2 is a schematic cross-sectional over view of the gender organ of a human female across the a-a' in FIG. 1.
Figure 3:
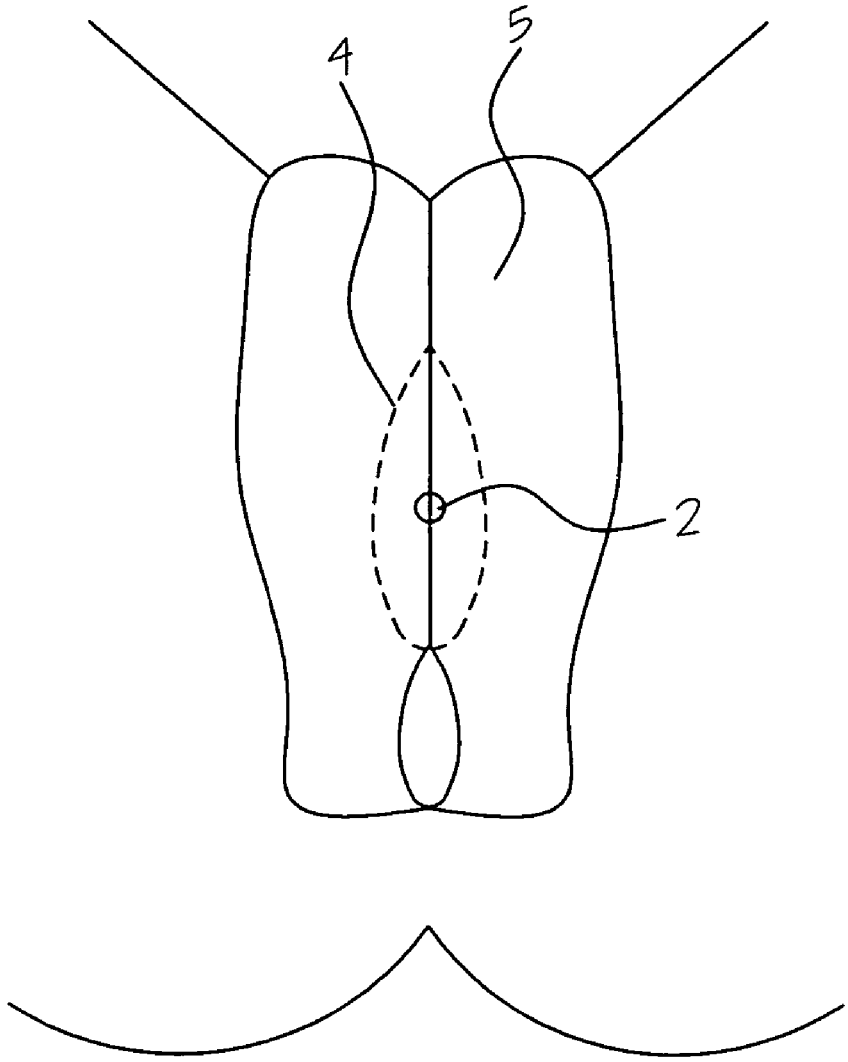
FIG. 3 is a schematic drawing of the view, seen from the point "b" in the FIG. 1, of the gender organ of a human female when a woman crouch down to do excursion.

FIG. 1 is a cross-sectional side view of a gender organ (1) of a human female shown in many medical dictionaries. And FIG. 2 is a cross-sectional over view of a gender organ (1) of a human female across the a-a' in the FIG. 1. As shown in the FIG. 1, the end (2) of the urethra meatus (3) of every woman is doubly covered by the Labia minor (4) and the Labia major (5) at normal time. Even when a woman opens legs, the end (2) of the urethra meatus (3) is not easily open to the air. Such double cover protects the gender organs from the bacteria outside. However, the situation is reversed when a woman urinates. FIG. 3 is a schematic drawing of the view, seen from the "b" in the FIG. 1, of the gender organ of a human female when a woman (6) crouch down to do excursion. As seen in the FIG. 3, the upper parts (7) of the Labia major (5) is still closed and only the lower part (8) thereof is slightly open to expose the entrance (9) of the vagina canal (10). Therefore, when a woman (6) urinates in a natural way or on a conventional commode, the urine drops can not be discharged directly to the air. Instead, the urine drops sweeps the inner surface of the Labia minor (4) first and then sweeps the lower inner surface of the Labia major (5). When a woman (6) uses a conventional commode and does not open the Labia with hand, the final direction of the ejaculation of the urine droplets is backward of the body of the woman (6). Therefore, every woman has to clean the inner-surface of the Labia with tissue or water after each urination. Sometimes the drops of urine wets all the way of inner-thighs of the woman. Then it needs more time to clean.

Figure 4:
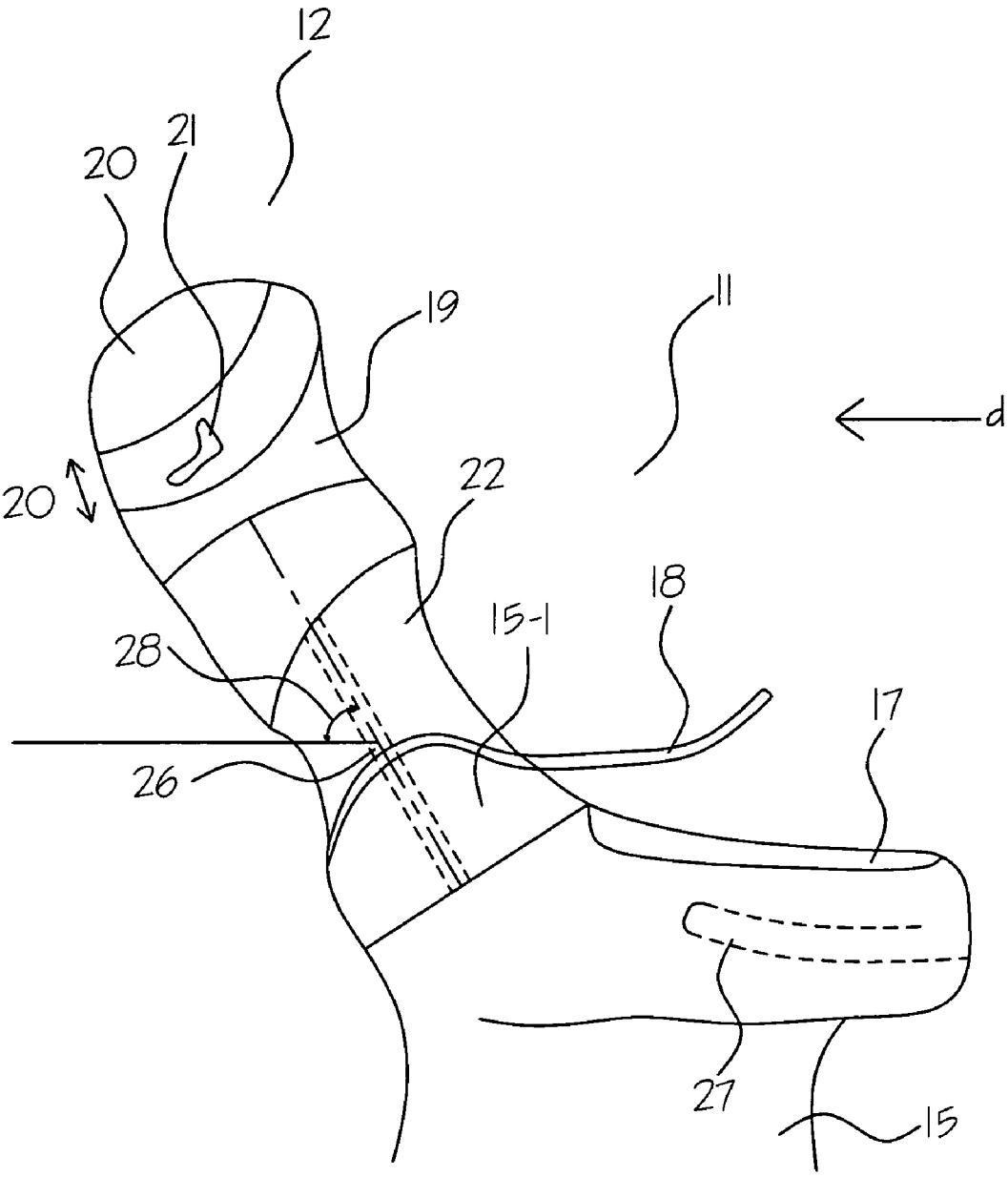
FIG. 4 is a side view of the ladies' hygiene commode of the current application.
Figure 5:
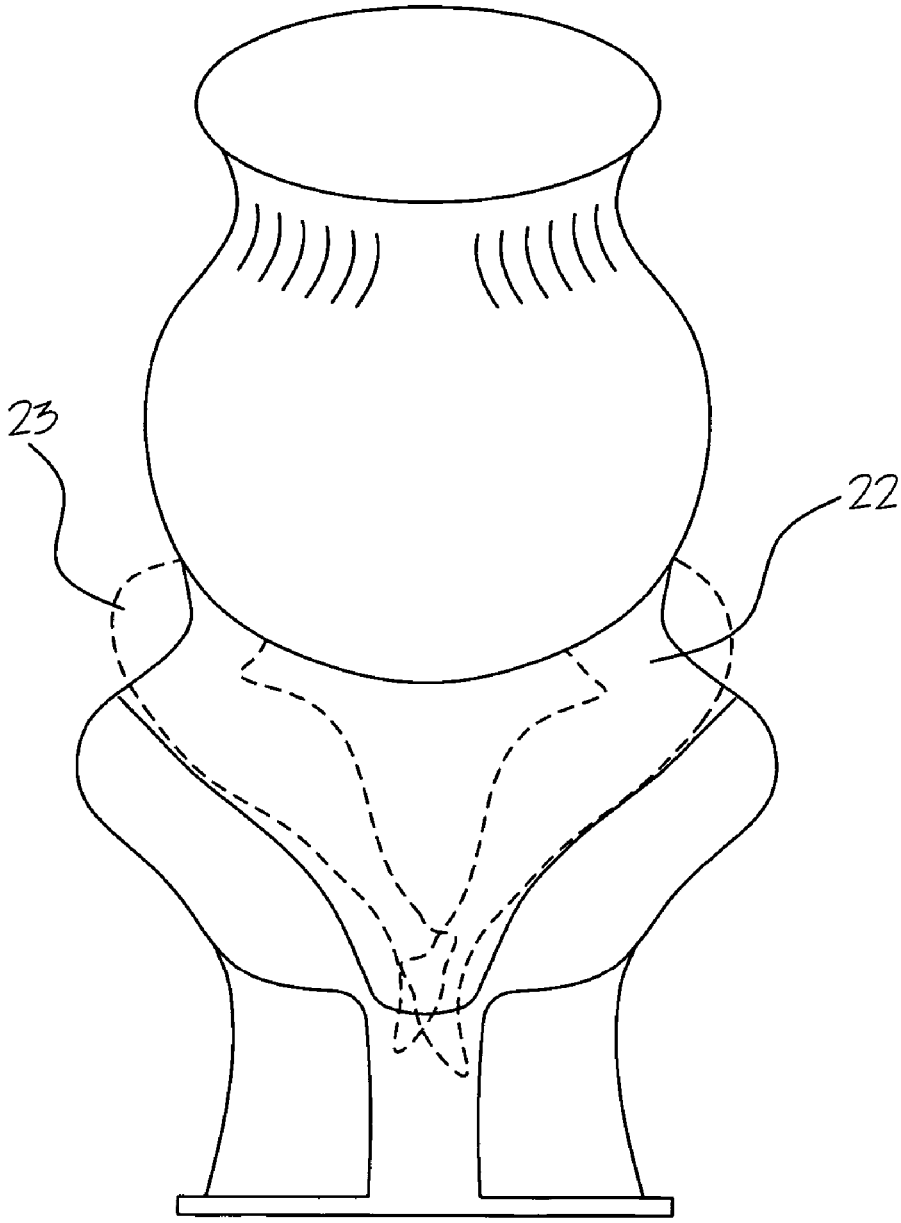
FIG. 5 is a rear view of the ladies' hygiene commode of the current application seen from the point 'c' in the FIG. 4

FIG. 4 is a side view of the ladies' reverse sitting hygiene commode (11) of the current application. The lady's reverse sitting hygiene commode (11) of the current application is comprised of a water tank (12), a base (13), a base plate (14), a bowl (15), a bowl lip (16), a seat (17) and a seat lid (18). As shown in the FIG. 4, the bowl (15) has unique shape. One side of the bowl (15), which is close to the water tank (12), has a risen part (15-1) and has a large concave groove (22) to receive legs of the woman user. The water tank (12) is leaned to the opposite direction of the bowl (15). The over all shape of the water tank (12) is smoothly rounded. A smooth, concave groove (19) is developed surrounding the water tank (12) along the latitudinal direction thereof on the upper portion. When a woman uses this commode (11), she can hold the water tank (12) with her arms to hold it (12). The width of the groove (19) is broad enough to receive the arms of a woman. When a woman sits on the commode (11), the seat lid (18), made of a flexible plastic film is fully opened and folded towards the water tank (12). The surface of the water tank (12) is covered with one of a soft material such as artificial fur made of polyester, natural animal fur, artificial polyurethane leather, animal leather, silicon rubber or cotton. Surface of the water tank is covered with one material mentioned above or a combination of the above mentioned materials. Thickness of the surface covered material is at lest 1 cm to 10 cm to make the water tank feels like human body. The water tank (12) covered with one of the soft material with 10 centimeter is designated to a ladies commode for the softness of the water tank (12)'s touching. The top of the water tank has a cover (20) that has a rounded upper surface. A flushing lever (21) is found at the side of the water tank (12) as other conventional water tank for commode. FIG. 5 is a rear view of the ladies' hygiene commode of the current application seen from the point 'c' in the FIG. 4. Another large concave groove (22) is developed around the rear part of the bowl (15). This groove (22) starts from the side of the rear part (closer to the water tank) of the bowl (15) to the rear side of the bowl (15). Two legs (23) of the woman user are engaged to the groove (22) to open her labia (4), (5) wide.

Figure 6:
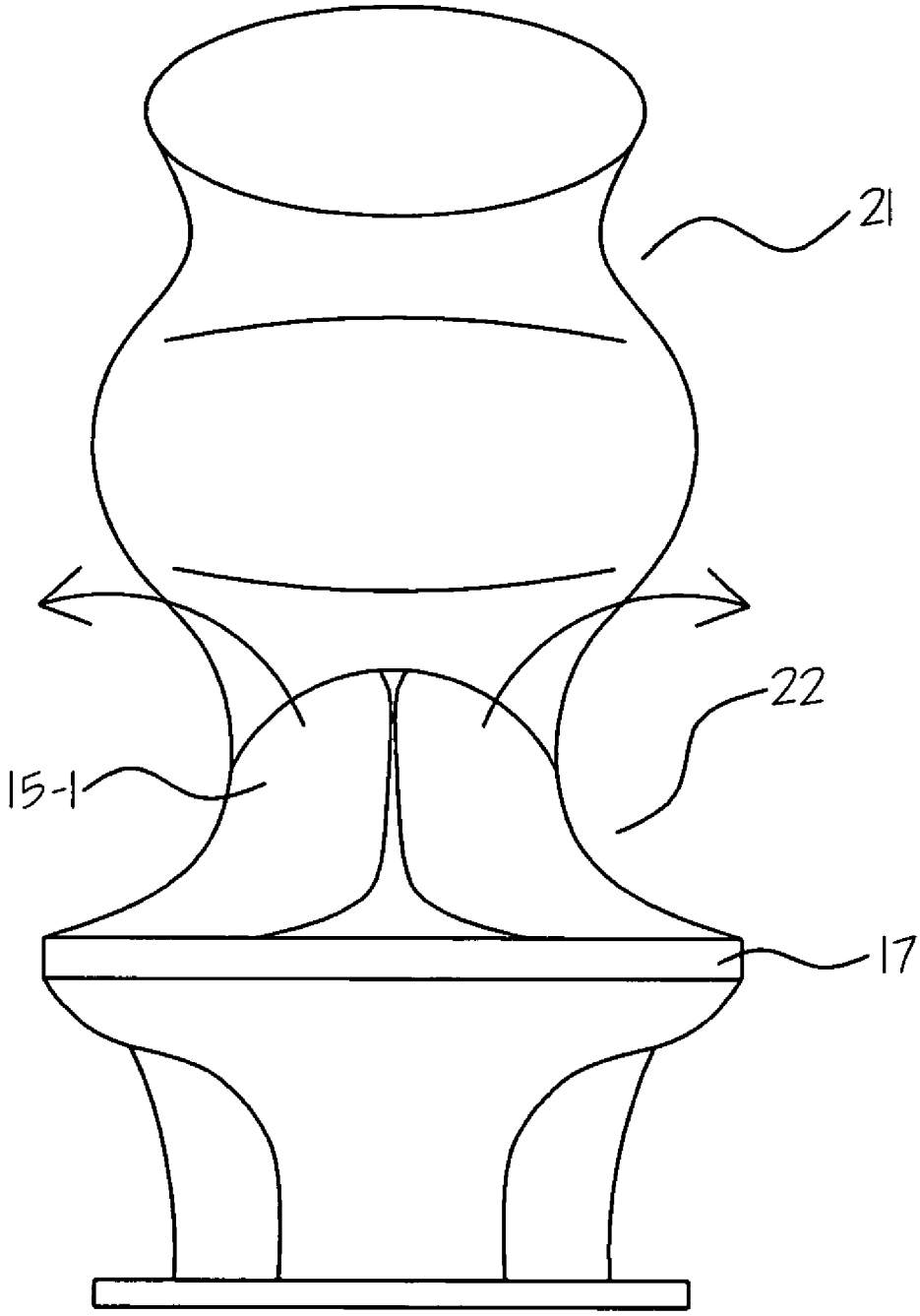
FIG. 6 is a front view of the ladies' hygiene commode of the current application, seen from the point 'd' in the FIG. 4.
Figure 7:
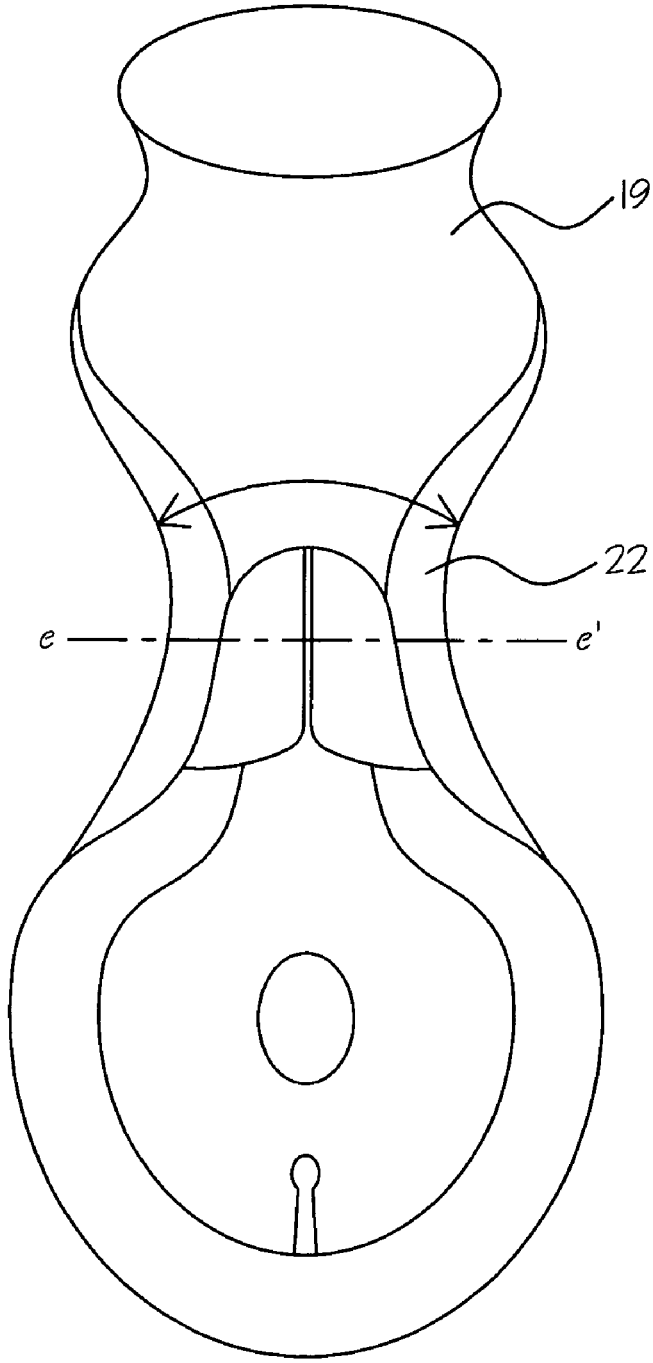
FIG. 7 is an over view of the ladies' hygiene commode of the current application.

FIG. 6 is a front view of the ladies' hygiene commode (11) of the current application, seen from the point 'd' in the FIG. 4. The groove (19) for receiving arms and another groove (22) for receiving legs of the woman user are shown clearly shown. The risen part (15-1) of the bowl (15) has bell shape front. FIG. 7 is an over view of the ladies' hygiene commode (11) of the current application. The over view of the commode (11) has shape of that of a motor cycle. The groove (22) for receiving a woman user's legs has special function as follows.

Different from any conventional commode, a woman user must open her legs to sit on the commode (11) of the current application. She surrounds the rear part of the bowl (15) with her legs and holds the water tank (12) with her arms. The position is like sit on a horse back while holding the neck of a horse with her arms. Then her legs are spread as the width (24) of the groove (22). Once she takes a position and hold the water tank (12), then she overlaps her legs (23) behind the bowl as shown in the FIG. 5 and pull her bottom area closer to the water tank (12). Then the inner thigh of the user spread more wide and as a result the labia (4), (5) of the user opens wide. The structure of the risen part aids to open the labia.

Figure 8:
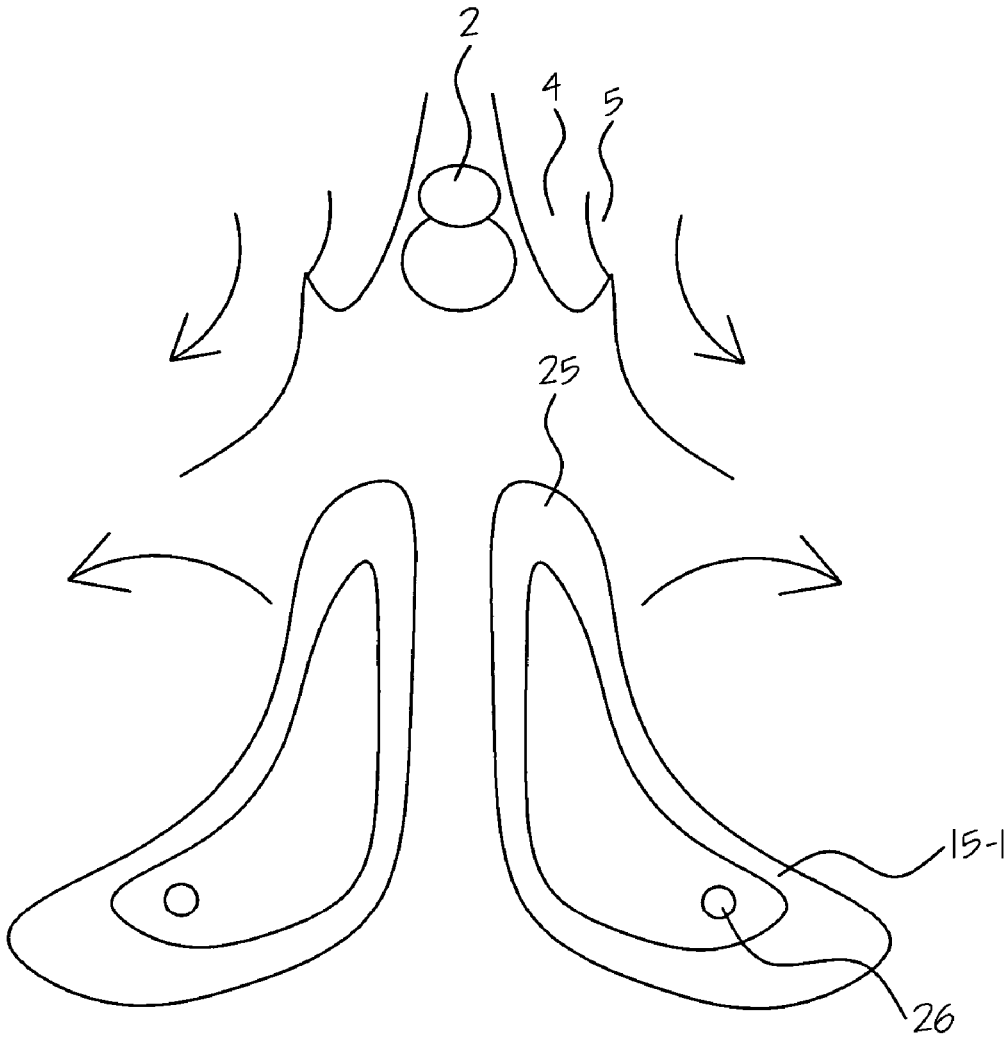
FIG. 8 is a cross-sectional front view of the risen part of the ladies, hygiene commode of the current application along the line e-e' in the FIG. 7.

FIG. 8 is a cross-sectional front view of the risen part of the ladies, hygiene commode of the current application along the line e-e' in the FIG. 7. The cross sectional view of the risen part (15-1) resembles wing of a speculum that is being used in a gynecologist. The tip (25) of the risen part (15-1) is in a narrow blade shape. However, the tip (25) is covered with soft silicon to protect the inner skin of labia and organs. The risen part (15-1) is rotatably connected to the rear part of the bowl (15) along the shaft (26) shown in the FIG. 1 and FIG. 8.

When a woman user surround her legs (23) around the groove (22) and pull her body close to the water tank (12), the risen part (15-1) rotates out ward and the tip (25) spreads the labia major (5) first and then spreads the labia minor. When the woman user's genetic organ is fully attached to the risen part (15), the end (2) of the urethra meatus (3) is exposed to the air and the droplets of urine are discharged directly to the air. At the same time, the water ejaculated from the viddette (27) can easily approach to the inner surface of the labia. The ladies' hygiene commode of the current application provides a position of almost lie on her face to a woman user while she crouches. Therefore, she can even rest at that position for an extended time.

To provide the lie on face position, the angle (28) between the water tank (12) and the horizontal ground is designed less than 30 degree.

For defecation, the angle (28) between the water tank (12) and the horizontal ground is increased by adjusting the water tank (12) into a more up-right position. A special mean for adjusting this angle (28) may be installed between the water tank (12) and the bowl (15). It is not specified in the current application.

What is claimed is:

1. A commode chair with reversed seat facing a water tank and with a system for opening the labia of female user for hygienic urination and excretion comprising a water tank that is leaned backwards with an angle of 30 degree to the horizontal ground in relation to the commode to allow a user to rest her upper body thereon and is smoothly rounded with a smooth, concave groove that is developed surrounding the water tank along the latitudinal direction thereof on the upper portion to receive the arms of a woman user and is covered with a cover having a thickness of 10 cm; a toilet bowl, which has a narrow width to the direction of a water tank and has wider width on the opposite side with an overview of a bicycle saddle shape facing the water tank; a viddette, which is located at the wider part of the bowl, to reach the inner side of the labia and clean therein from behind of a female user; the toilet bowl has a large concave groove that starts from the side of the rear part of the bowl to the rear side of the bowl to allow labia of a woman user open wide when two legs of the woman user are engaged thereto, and has a side with a risen part that is rotatably connected to the rear part of the bowl along a shaft to open the labia major first and then spreads the labia minor when a woman user surround her legs around the large groove and pull her body close to the water tank by rotating out ward and allow the tip spreads the labia major to expose the end of the urethra meatus to the air and allow the droplets of urine discharged directly to the air and allow the water ejaculated from the viddette easily approach to the inner surface of the labia and the risen part resembles wing of a speculum that is being used in a gynecologist and narrow blades shaped tip that is covered with soft silicon to protect the inner skin of labia and organs and locates close to the water tank; and the commode further has a base, a base plate, a bowl lip, a seat that is formed to support a user to sit on the commode facing the water tank, and a seat lid, which made of a flexible plastic film that is fully opened when a woman user sits thereon.

2. The commode chair with reversed seat facing a water tank and with a system for opening the labia of female user for hygienic urination and excretion of claim 1, wherein the cover for the water tank is made from an artificial fur made of polyester.

3. The commode chair with reversed seat facing a water tank and with a system for opening the labia of female user for hygienic urination and excretion of claim 1, wherein the cover for the water tank is made from animal leather.

4. The commode chair with reversed seat facing a water tank and with a system for opening the labia of female user for hygienic urination and excretion of claim 1, wherein the cover for the water tank is made from silicon rubber.

* * * * *